United States Patent [19]

Conn, Jr. et al.

[11] Patent Number: 4,843,337

[45] Date of Patent: Jun. 27, 1989

[54] DRIVEWAY SAFETY LIGHT

[76] Inventors: Roy S. Conn, Jr., 1404 James St., Cedar Hill, Tex. 75104; George Spector, 233 Broadway, 3815 Woolworth Building, New York, N.Y. 10007

[21] Appl. No.: 115,380

[22] Filed: Nov. 2, 1987

[51] Int. Cl.[4] ..... G08G 1/07

[52] U.S. Cl. ..... 340/906; 340/902; 340/907; 340/908; 340/904; 340/309.15; 340/309.4; 341/176

[58] Field of Search ..... 340/906, 902, 907, 908, 340/904, 825.72, 51, 539, 696, 825.69, 309.15, 309.4; 455/89, 95

[56] References Cited

U.S. PATENT DOCUMENTS

| | | | |
|---|---|---|---|
| 3,530,432 | 9/1970 | Pope | 340/51 |
| 4,017,825 | 4/1977 | Pichey | 340/906 |
| 4,115,757 | 9/1978 | Blahunka | 340/906 |
| 4,135,144 | 1/1979 | Elmasian | 340/906 |
| 4,443,783 | 4/1984 | Mitchell | 340/906 |
| 4,736,186 | 4/1988 | Jones | 340/906 |

*Primary Examiner*—Donnie L. Crosland

[57] ABSTRACT

A driveway safety light system is provided and consists of a transmitter within a motor vehicle to activate a lamp connected to a receiver at a corner on end of a driveway so as to indicate to anyone driving down a road that the motor vehicle is about to exit from the driveway.

5 Claims, 1 Drawing Sheet

DRIVEWAY SAFETY LIGHT

BACKGROUND OF THE INVENTION

The instant invention relates generally to visual identification control systems and more specifically it relates to a driveway safety light system.

Numerous visual identification control systems have been provided in prior art that are adapted to guide people, such as in motor vehicles, to proper locations or destinations. For example, U.S. Pat. Nos. 1,586,361; 2,920,184 and 3,325,782 all are illustrative of such prior art. While these units may be suitable for the particular purpose to which they address, they would not be as suitable for the purposes of the present invention as heretofore described.

SUMMARY OF THE INVENTION

A primary object of the present invention is to provide a driveway safety light system that will overcome the shortcomings of the prior art devices.

Another object is to provide a driveway safety light system that is activated from an ignition switch in a motor vehicle to indicate to anyone driving down a road that the motor vehicle is about to exit from the driveway.

An additional object is to provide a driveway safety light system that includes a built in timer so that the light will turn off at a predetermined time interval.

A further object is to provide a driveway safety light system that is simple and easy to use.

A still further object is to provide a driveway safety light system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
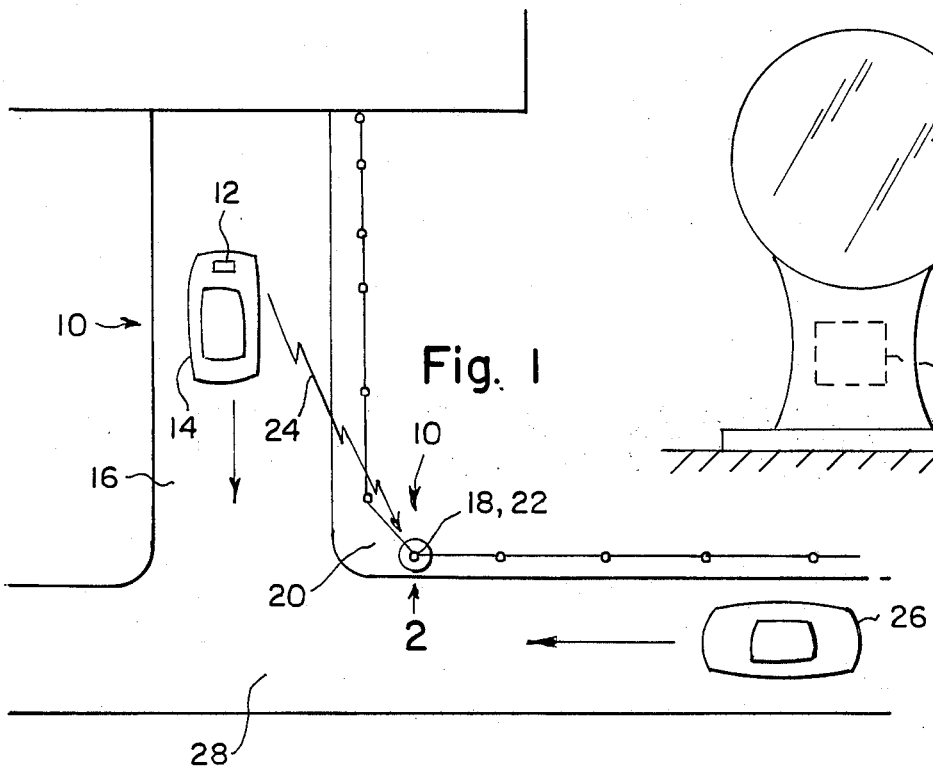
FIG. 1 is a top plan view of the invention in use with a lamp mounted at corner of a driveway.
Figure 2:
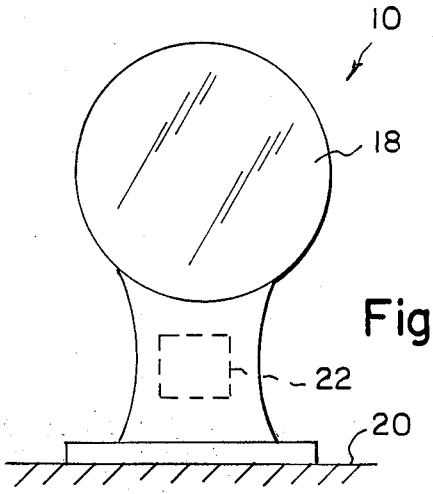
FIG. 2 is a front elevational view of the lamp and receiver assembly as indicated by arrow 2 in FIG. 1.

Turning now descriptively to the drawings, in which similar reference characters denote similar elements throughout the several views, FIGS. 1 through 4 illustrate a driveway safety light system 10 that consists of a transmitter 12 located within a first motor vehicle 14 on a driveway 16. The transmitter is operated by a person (not shown) within the first motor vehicle 14. A lamp 18 is positioned at a corner end 20 of the driveway 16. A receiver 22 located within the lamp 18 is activated by a signal 24 from the transmitter to illuminate the lamp 18 so as to indicate a warning to anyone driving in a second motor vehicle 26 down a road 28, which communicates with the driveway 16, that the first motor vehicle 14 is about to exit from the driveway 16.

Figure 3:
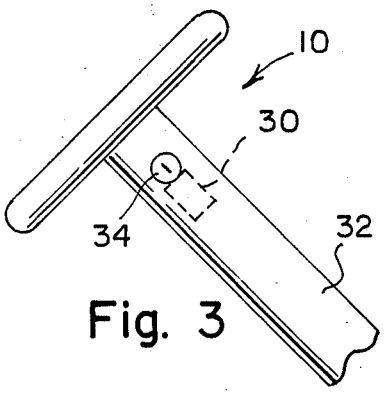
FIG. 3 is a side view of a steering column with a time delay switch adjacent and operated by the ignition switch.
Figure 3A:
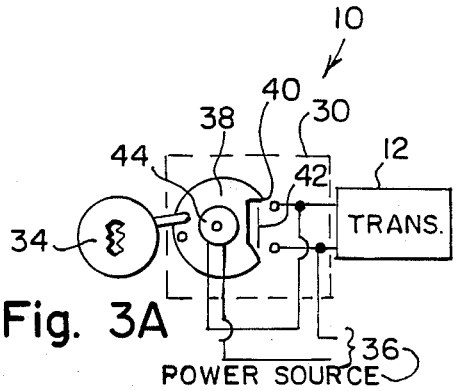
FIG. 3A is a schematic diagram showing operation of the ignition switch which will activate the time delay switch to operate the transmitter.
Figure 4:
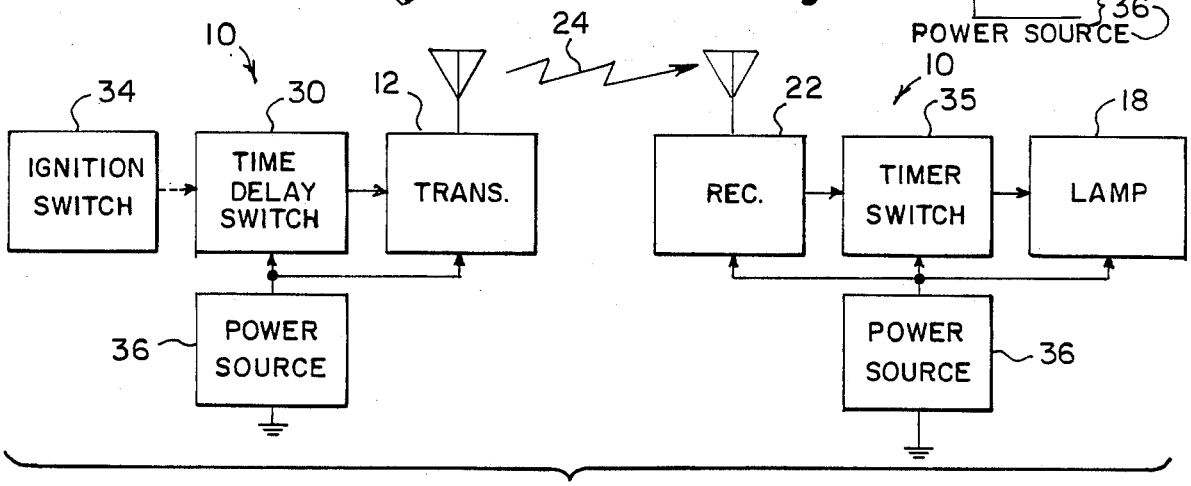
FIG. 4 is a block diagram of the electrical circuit of the invention showing the transmitter and receiver systems.

A time delay switch 30 is mounted on a steering column 32 and is electrically connected from a power source 36, such as a battery or house current, to the transmitter 12 so as to be activated by an ignition switch 34. The time delay switch 30 controls the transmitter 12 so that the transmitter will turn off at a predetermined time interval. The time delay switch 30, as shown in FIG. 3A, contains a cam 38 that has a cut out area 40. The cam 38 closes a normally opened, spring biased switch member 42 to activate the transmitter 12 when the ignition switch 34 is turned on. A motor 44 is electrically connected to the switch member 42 whereby the motor 44 operates the cam 38 until the cut out area 40 reaches the switch member 42 thus turning off the motor 44 until the ignition switch 34 is turned on again.

A timer switch 35 is mounted within the lamp 18 and is electrically connected from the power source 36 between the receiver 22 and lamp, so that the timer switch 35 will turn off the lamp at a predetermined time interval. The color of the lamp 18 can be selected from the group consisting of amber, red, green and blue. The lamp 18 can be activated automatically by the remote control transmitter 12 or by manual operation. The lamp 18 can be a flashing light, rotating beacon type or steady burn. The driveway safety light system 10 can be adapted to crosswalk,s places where fork lifts are used, factories, military bases, etc. and not only for motor vehicles but also for people.

The transmitter 12 might operate in conjunction with a garage door opener unit, be a hand held unit or be a proximity transmitter. The receiver 22 and transmitter 12 might both be mobile or stationary. The transmitter 12 may or may not operate in conjunction with the time delay switch 30. The driveway safety light system 10 can be simply installed for home owners as well as construction workers or the like. The range of the transmitter 12 should be maximum distance allowed by FCC or as required. and the receiver 22 may also have an audible signal alarm.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A driveway safety light system which comprises:

(a) a transmitter located within a first motor vehicle on a driveway, said transmitter activated by means within the first motor vehicle responsive to ignition operation;

(b) a lamp positioned at a corner end of the driveway; and (c) a receiver located within said lamp, said receiver activated by a signal from said transmitter, to illuminate said lamp so as to indicate a warning to anyone driving in a second motor vehicle down a road, which communicates with the driveway, that the first motor vehicle is about to exit from the driveway.

2. A system as recited in claim 1, wherein said means further comprise a time delay switch mounted on a steering column electrically connected with a power source and said transmitter whereby said time delay switch is activated by ignition switch operation to operate said transmitter for fa predetermined time interval.

3. A system as in claim 2 including a timing means for operating said switch at specific time intervals actuated simultaneously by said ignition key.

4. A driveway safety light system as recited in claim 3 further comprising a timer switch mounted with said lamp which is electrically connected to the power source, said receiver and said lamp, so that said timer switch will turn off said lamp at a predetermined time interval.

5. A driveway safety light system as recited in claim 3 wherein said timing means further comprises:

(a) a cam having a cut out area;

(b) a normally opened spring biased switch member closed by said cam to activate said transmitter when the ignition switch is turned on; and (c) a motor electrically connected to said switch member whereby said motor operates said cam until the cut out area reaches said switch member thus turning off said motor until the ignition switch is turned on again.

* * * * *